US007997055B2

(12) United States Patent
Brenk

(10) Patent No.: US 7,997,055 B2
(45) Date of Patent: Aug. 16, 2011

(54) METHOD FOR THE THERMAL TREATMENT OF A RUNNING YARN AND TWISTING MACHINE FOR CARRYING OUT THE METHOD

(75) Inventor: Siegfried Brenk, Krefeld (DE)

(73) Assignee: Oerlikon Textile GmbH & Co KG, Monchengladbach (DE)

( * ) Notice: Subject to any disclaimer, the term of this patent is extended or adjusted under 35 U.S.C. 154(b) by 263 days.

(21) Appl. No.: 12/310,407

(22) PCT Filed: Jul. 18, 2007

(86) PCT No.: PCT/EP2007/006339

§ 371 (c)(1),
(2), (4) Date: Feb. 24, 2009

(87) PCT Pub. No.: WO2008/025411

PCT Pub. Date: Mar. 6, 2008

(65) Prior Publication Data

US 2009/0320437 A1 Dec. 31, 2009

(30) Foreign Application Priority Data

Aug. 26, 2006 (DE) ..... 10 2006 040 065

(51) Int. Cl.
*D01H 13/10* (2006.01)

(52) U.S. Cl. ..... 57/282; 57/309

(58) Field of Classification Search ..... 57/282, 57/309; 68/5 C, 5 D, 5 E
See application file for complete search history.

(56) References Cited

U.S. PATENT DOCUMENTS

| | | | | | |
|---|---|---|---|---|---|
| 3,721,376 | A * | 3/1973 | Christian et al. | 226/42 |
| 3,726,137 | A * | 4/1973 | Denton | 73/160 |
| 3,763,526 | A * | 10/1973 | Benson et al. | 28/220 |
| 3,763,669 | A * | 10/1973 | Bous et al. | 68/5 D |
| 4,295,252 | A * | 10/1981 | Robinson et al. | 28/248 |
| 4,566,319 | A * | 1/1986 | Yamazaki et al. | 73/160 |
| 5,146,739 | A * | 9/1992 | Lorenz | 57/264 |
| 5,802,832 | A | 9/1998 | Foster | 57/264 |
| 6,209,302 | B1 | 4/2001 | Wortmann et al. | 57/290 |
| 7,475,573 | B2 | 1/2009 | Brenk | 68/5 E |
| 2005/0102764 | A1 | 5/2005 | Brenk | 8/149.3 |
| 2006/0090368 | A1 | 5/2006 | Uku et al. | 34/380 |

FOREIGN PATENT DOCUMENTS

| | | | |
|---|---|---|---|
| DE | 103 48 278 | A1 | 5/2005 |
| EP | 1 348 785 | A1 | 10/2003 |
| EP | 1 609 897 | A1 | 12/2005 |
| GB | 458098 | | 12/1936 |
| WO | WO 98/33963 | | 8/1998 |
| WO | WO 2005/038106 | A1 | 4/2005 |

* cited by examiner

*Primary Examiner* — Shaun R Hurley
(74) *Attorney, Agent, or Firm* — K&L Gates LLP

(57) ABSTRACT

Method for thermal treatment of a running yarn (14) on a multi-workstation twisting machine, each station having a device (1) for thermal treatment of the yarn, and a delivery system (2, 3) preceding or following such device (1). The yarn (14) passes through the device (1) substantially without tension, and after passing the downstream delivery system (3), is wound. The yarn (14) is loaded with a defined force by position-variable means (24, 25, 27). Position changes of such means caused by a change in the yarn tension under disruptive influences during the thermal treatment of the yarn (14) are used as a control variable for controlling at least one of the delivery systems (2, 3).

9 Claims, 2 Drawing Sheets

METHOD FOR THE THERMAL TREATMENT OF A RUNNING YARN AND TWISTING MACHINE FOR CARRYING OUT THE METHOD

CROSS-REFERENCE TO RELATED APPLICATIONS

This application claims the benefit of German patent application 10 2006 040 065.8, filed Aug. 26, 2006, herein incorporated by reference.

FIELD OF THE INVENTION

The invention relates to a method for treating a running yarn and a twisting machine for carrying out the method.

Methods for treating a yarn and devices for carrying out the method are known from the prior art and are used to improve the yarn quality after the twisting or cabling of yarns. It is thus conventional to subject the yarn to a thermal treatment after twisting processes. The thermal treatment stabilises the state of the yarn after the twisting and frees the yarn of inner torsional forces. In addition, the thermal treatment leads to a shrink-bulking of the yarn, which causes an increase in volume of the yarn.

It has been conventional for a long time, for thermal treatment, to treat the yarn that has been wound onto bobbins or cops batch-wise in steaming systems, so-called autoclaves. In this case, a large number of bobbins or cops are set simultaneously.

It is known from European Patent Document EP 1 348 785 A1 and German Patent Document DE 103 48 278 A1 to carry out the setting continuously on the running yarn at each workstation of the twisting machine. The setting process is thus to be carried out more economically and efficiently. Both European Patent Document EP 1 348 785 A1 and German Patent Document DE 103 48 278 A1 in each case show a device for thermal treatment through which the yarn runs in a linear manner. A gaseous or vaporous treatment medium under pressure is blown into a thread treatment chamber for thermal treatment. The following process for cooling leads to the setting of the yarn. The opposing inlet and outlet openings have thread sluices, which are used to seal the thread treatment chamber with respect to the environment. The guidance of the yarn through the device is achieved in each case by a delivery system preceding the device and a delivery system downstream of the device. For this purpose, the two delivery systems of the respective workstation are activated in such a way that the yarn running through the device is held substantially without tension. Directly after leaving the treatment device, the yarn, as shown by German Patent Document DE 103 48 278 A1, is wound onto a bobbin in order to be further processed into a subsequent product, for example a carpet or the like.

The quality of a subsequent product produced from a yarn treated and produced in this manner is determined inter alia by the bulkiness. The bulkiness should be particularly high and above all uniform for qualitatively high-grade carpets, for example the quality Saxony. The bulkiness of the yarn set in the above-described manner is influenced according to European Patent Document EP 1 348 785 A1 by predeterminable different speeds of the delivery systems when running through the device. For this purpose, a defined different speed is pre-adjusted between the two delivery systems to achieve predetermined property values of the yarn. A regulating device intervening in the event of deviations of the adjusted speed difference owing to disruptive influences is not described.

No dedicated regulating device of the delivery systems can be inferred from German Patent Document DE 103 48 278 A1 either, so the bulkiness cannot be influenced during the treatment process. Disruptive influences occurring during the treatment, such as, for example, an undesired deviation in the rotational speed of the delivery systems, different thread input tensions, diameter deviations of the delivery system rollers because of wear or different contact pressure of the delivery system rollers during the thermal treatment of the yarn or irregularities in the feed material are not compensated. However, all these factors considerably influence the bulkiness of the yarn and therefore the quality of the subsequent product.

SUMMARY OF THE INVENTION

The object of the invention is to provide a method which makes the treatment of the yarn more effective and to provide a twisting machine which is set up for simple and economical implementation of the method.

The object is achieved by a method and a twisting machine wherein the passing thread is loaded with a defined force by position-variable means, the change in position of which caused by a change in the yarn tension because of disruptive influences during the thermal treatment of the yarn is used as a control variable to control at least one of the delivery systems. The loading of the passing thread with a defined force causes the means, upon a change in the speed of the delivery systems due to disruptive influences, which leads to a corresponding change in the yarn tension, to undergo a change in position. The change in the position of the means takes place in accordance with the change in speed of the delivery systems. In other words, with an increasing speed difference and an increase in the yarn tension or shortening of the yarn length accompanying this, the position of the means is changed by a movement of the means directed counter to the direction of action of the force applied to the yarn. On the other hand, a reduction in the speed difference of the delivery systems leads to a decrease in the yarn tension or an increase in the yarn length, which can lead to a loop or lap formation. The reduction in the yarn tension brings about a dynamic position change of the means in such a way that the means change their position in the direction of action of the force applied.

The change in position of the means is used as a control variable for controlling the speed of at least one of the delivery systems. By using the change in position of the means as a control variable for the activation of at least one of the delivery systems it can be ensured that the yarn guided by the device for thermal treatment is always kept substantially constantly without tension during the entire treatment process. For this purpose, a change corresponding to the change in position, of the delivery system speed of at least one of the two delivery systems is carried out to compensate the speed difference occurring. The control of at least one of the delivery systems as a function of the occurring change in position of the means for influencing the yarn tension allows disruptive influences such as the rotational speed deviation of the delivery systems or a diameter deviation of the delivery system rollers caused by production or wear to be eliminated. Likewise, different pressure forces of a resilient delivery system roller or different entraining of the yarn owing to the delivery system rollers of one or both delivery systems can be compensated, as can different yarn input tensions which lead to different elongations of the yarn.

Compensating the speed difference because of a deviation in the rotational speed of the two delivery systems and/or other above-mentioned disruptive influences by the method according to the invention avoids a lap formation owing to yarn which is too loose and therefore also contact with hot surfaces of the device for thermal treatment which can lead to yarn breaks, a reduction in the yarn quality or the like.

Furthermore, it can be avoided by the method that the yarn is guided too tautly by the device, so reduction in bulk because of yarn tension which is too great is avoided during the treatment of the yarn. Likewise, incorrectly pre-adjusted shrinkage of the yarn between the delivery systems can be avoided as, owing to the control according to the invention of at least one of the two delivery systems, the pre-adjusted shrinkage becomes automatically adaptable to the corresponding material properties of the yarn to be treated. This allows the investigation outlay required of the bulk capacity of a yarn material to be reduced if this is not known, or only approximately, at the time of treatment. The adjustment of a safety deduction in a pre-adjusted maximum value for the shrinkage of the yarn, as generally conventional, can be dispensed with, as the pre-adjusted value for the shrinkage, as already stated, is automatically adaptable to the properties of the yarn to be treated. Owing to the method according to the invention, yarn influencing variables such as a different yarn construction, the thread titre or various yarn materials are taken into account during the thermal treatment to achieve a bulkiness, which is as large as possible and remains constant, of the yarn to be treated.

In particular, the order of magnitude of the force applied by the means may be to 1 cN. The force applied to the yarn is sufficiently great to already bring about a slight change in position of the means to influence the yarn tension on the occurrence of a small counterforce, caused by a change in the yarn tension, which is to be attributed to the disruptive influences already described. However, the force applied is so small that the state of the yarn that is substantially without tension is retained at all times in the device for thermal treatment during the treatment of the yarn as long as an operational disturbance does not occur which interrupts the entire course of the production.

Furthermore, the order of magnitude of the force applied by the means to the yarn can be kept constant. Owing to the loading which always remains constant of the running yarn by the force applied by the means in an order of magnitude of less than 1 cN, the means and the control are simplified with regard to their configuration.

Preferably, saturated steam or hot steam can be used for the thermal treatment of the yarn. Alternatively, hot air can also be used as a medium for the thermal treatment.

With regard to the twisting machine, it is proposed that a mechanism for influencing the yarn tension is arranged between the two delivery systems and comprises means which are configured so as to be at least partially position-variable to load the yarn with a defined force, the mechanism being connected to a control mechanism which is set up to use the change in position of the means of the control mechanism as a control variable to control the speed of at least one of the delivery systems. In this case, it is possible for only the means loading the yarn with a force of the mechanism to be variable with regard to the position thereof, and this makes the construction of the mechanism simpler and therefore more economical.

The control mechanism may be configured for this purpose as a central control mechanism, as a control mechanism working section-wise or else as a control mechanism which is provided at each workstation of the twisting machine, which inter alia activates at least one of the delivery systems of each workstation of the twisting machine.

Each workstation can preferably have a sensor system, which determines the order of magnitude of the change in the position of the mechanism and passes it to the control mechanism. This allows the dynamic adaptation of the delivery system speed to each individual device for thermal treatment of the yarn of a workstation of the twisting machine. As a result, a flexible reaction can automatically take place to disruptive influences occurring, in particular including different disruptive influences.

The mechanism may preferably be arranged in the region of one of the delivery systems. Thus, the mechanism may, for example, directly precede the delivery system downstream of the device or else already be in the cooling zone preceding this delivery system.

In this case, the mechanism may be pivotably arranged on a delivery system roller of one of the two delivery systems about the pivot pin thereof. The mechanism is preferably arranged on one of the delivery system rollers of the delivery system downstream of the device for thermal treatment. The mechanism is arranged in the region of at least one delivery system in such a way that the yarn is loaded with a force before leaving the downstream delivery system or before entering the device for thermal treatment.

The mechanism may advantageously have a lever, which can be pivoted about the pivot pin of a delivery system roller, with a deflection roller rotatably mounted on the lever. To determine the change in position, the deflection of the lever is detected by means of the sensor system. The data detected by the sensor system are passed to the control mechanism and evaluated there. By means of these data, at least one of the delivery systems is influenced with respect to its delivery speed in order to keep the running thread as uniformly as possible substantially without tension during its treatment. The lever, on the one hand, is used to determine the change in position of the mechanism, but can also be used to adjust the magnitude of the force applied to the yarn as the lever can also be used as a counterweight to the deflection roller which loads the yarn with a defined force directed perpendicular to the yarn running direction.

Alternatively, the mechanism can be configured as an axially movable bolt. For this purpose, the bolt is axially movably mounted in a bearing mechanism, which is arranged in the region of at least one of the delivery systems. In this case, the bolt and the bearing device may also be accommodated in a housing which protects the bolt and the bearing mechanism from influences which may impair the axial movability of the bolt. The bolt and its bearing mechanism or the housing are arranged in such a way in the region of at least one of the delivery systems that the bolt can load the passing yarn with a defined force directed perpendicularly to the yarn running direction.

The device for thermal treatment of the yarn may be a steam setting mechanism. The thermosetting takes place by loading the running yarn with saturated steam or hot steam in a steam treatment space arranged downstream of the yarn source and adequate cooling following this.

BRIEF DESCRIPTION OF THE DRAWINGS

Further details of the invention are described with the aid of the views of the figures, in which.

DETAILED DESCRIPTION OF THE PREFERRED EMBODIMENTS

Figure 1:
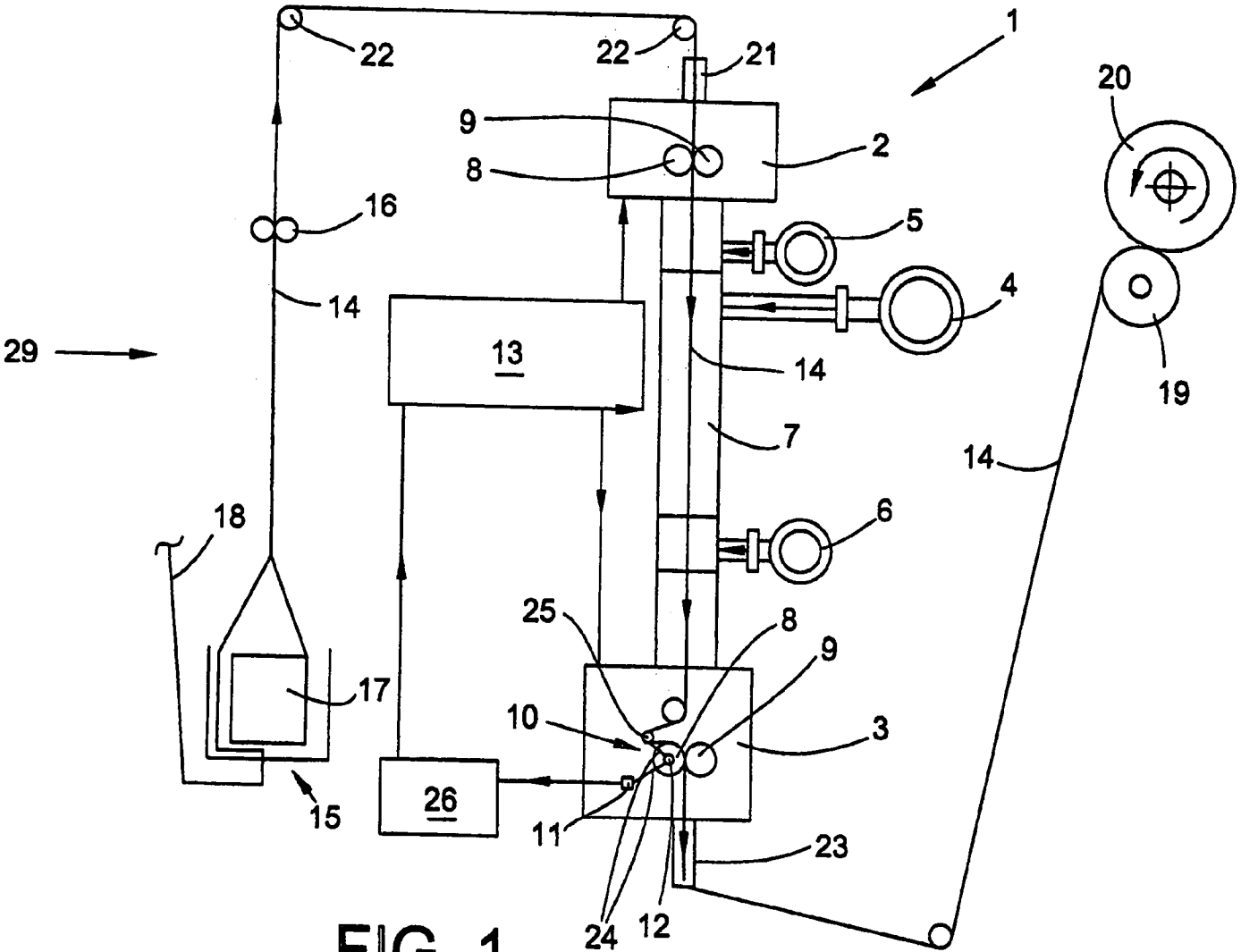
FIG. 1 shows a schematic diagram of a workstation of a twisting machine with a mechanism for influencing the yarn tension.

FIG. 1 shows a schematic view of a workstation 29 of a twisting machine. The twisting machine is a textile machine with a large number of workstations 29 located next to one another. A row of workstations 29 constructed in the same way is arranged on each longitudinal side of the textile machine in each case. Each workstation 29 has a steam setting device 1, which is used to set the yarn 14 drawn from the twisting mechanism. Furthermore, each workstation 29 has a control mechanism 13, which is used to control the components of the workstation 29.

Supplied to a thread 17 which is drawn from a twisting pot 15 is a creel thread 18, which is twisted therewith to form a yarn 14. The yarn 14 is drawn by a yarn draw-off device 16, merely indicated. The drawn-off yarn 14 leaves the region of the twisting mechanism and is supplied by means of a deflection means 22 to a device for thermal treatment of the yarn. The device is configured as a steam setting device, which can be operated with saturated steam or hot steam. After leaving the steam setting mechanism 1, the yarn 14 is guided by means of further deflection means to a winding device on the workstation 29 and wound to form a cross-wound bobbin 20. The cross-wound bobbin 20 is rotatably held by a pivotable creel and rests on a winding roller 19, by which it is driven and made to rotate to wind the yarn 14.

The steam for the steam setting mechanism 1 is supplied by a steam line of the twisting machine by means of a steam supply 4. The supply of steam may be interrupted by a shut-off mechanism configured as a steam valve.

The steam fixing device 1 has an upstream delivery system 2 and a downstream delivery system 3, which are used to supply the yarn 14 to be treated or for removing the treated yarn 14. For this purpose, the two delivery systems 2, 3 are driven in such a way that the yarn 14 passing through the steam setting device 1 is kept substantially constantly without tension. In this case, a yarn sluice 21, 23 is arranged in each case on the input side of the delivery system 2 or on the output side of the delivery system 3, through which sluices the yarn 14 enters or leaves the steam setting device 1. The delivery systems 2, 3 have delivery system rollers 8, 9, at least one of the delivery system rollers 8, 9 of the respective delivery system 2, 3 preferably being driven by a single motor.

The guiding of the yarn 14 through the steam zone 7 of the steam fixing device 1 takes place substantially constantly without tension to achieve the greatest possible bulkiness of the yarn 14 during the thermal treatment.

Arranged downstream of the supply mechanism 2 is a compressed air supply 5, which is connected upstream of the steam zone 7. Steam is supplied in the form of hot steam or saturated steam by means of the steam supply 4. Adjoining the steam zone 7 is a further compressed air supply 6, which is connected upstream of the delivery system 3. The delivery system 3, in addition to the delivery system rollers 8, 9, has a mechanism for loading the yarn 14 with a defined force. The mechanism 10 comprises means, which are at least partly configured so as to be position-variable. The means are configured as a deflection roller 25 in the embodiment according to FIG. 1, which is arranged by means of a lever arm 24 on a pivot pin 12 of the delivery system roller 8 so as to be pivotable about it. An arrangement of this type of the deflection roller 25 and lever arm 24 is, for example, known by the term dancing roller. The mechanism 10 is arranged upstream of the delivery mechanism 3 and loads the treated yarn 14 after it leaves the steam zone 7 but before entering the delivery system 3 with a defined force directed perpendicular to the yarn draw-off direction. This force is preferably less than 1 cN. The defection of the yarn 14, shown greatly exaggerated in FIG. 1, by the deflection roller 25 of the mechanism 10 is merely used to better illustrate the mode of functioning. The actual deflection of the yarn 14 is small because of the slight force, which is applied by the mechanism 10 on the yarn 14.

The lever arm 24 is connected to a sensor system 11, which detects any changes in position of the means of the mechanism 10, in particular of the lever arm 24 owing to the deflection roller 25 located thereon and passes this to the control mechanism 13. The change in position is caused by a deflection of the deflection roller 25 because of a changing yarn tension or yarn length between the two delivery systems 2, 3. The change in the yarn tension may have diverse causes, for example a deviation in rotational speed of the delivery system 2, 3, different thread input tensions or a diameter deviation of the delivery system rollers 8, 9 because of wear.

Thus, a deviation in rotation of speed of the delivery system 3 compared to the delivery system 2, for example, leads to a speed difference, which brings about an increase or decrease in the yarn tension according to its sign. An increase in the yarn tension, in other words a reduction in the yarn length, brings about a counterforce, which changes the position of the mechanism 10 counter to its load direction. The change in position of the deflection roller 25 is detected as a deflection of the lever arm 24 by the centre system 11 and can be passed to a measured value converter 26. The measured value converter 26 relays a signal proportional to the deflection to the control mechanism 13, which signal is in turn used to regulate the speed of the delivery systems 2, 3. In the case described above, this leads to a reduction in the speed difference of the delivery systems 2, 3, to keep the yarn 14 substantially without tension.

The measurement and regulation takes place dynamically during the running process, in other words while the yarn 14 is passing through the steam setting mechanism 1 at each workstation 29. As a result, a maximum bulkiness of the yarn 14 can be achieved as disruptive influences which impair the bulk development can be taken into account dynamically at each instant.

Figure 2:
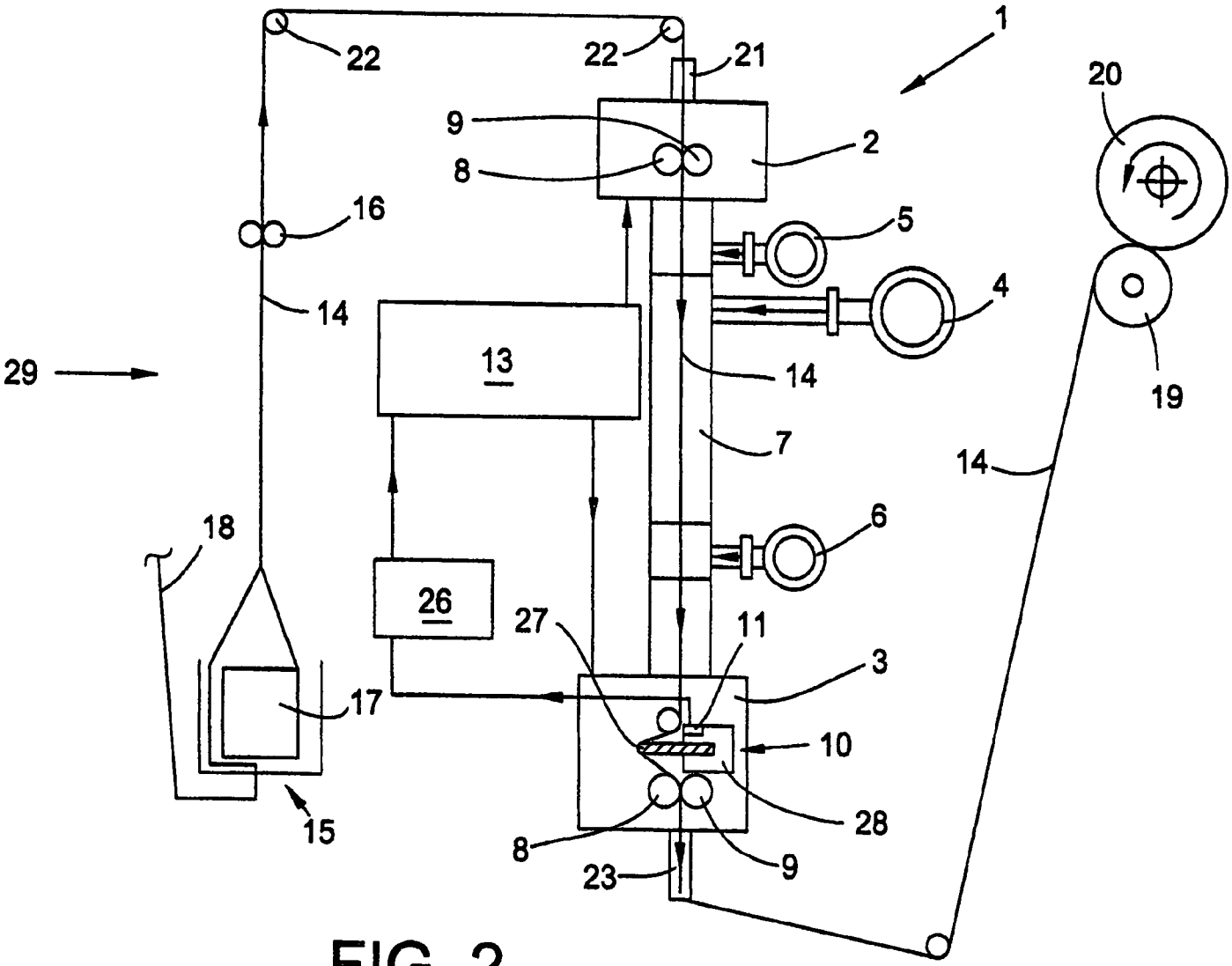
FIG. 2 shows a schematic diagram of a workstation according to FIG. 1 with a second embodiment of the mechanism.

In an alternative embodiment of the inventive twisting machine according to FIG. 2, the means of the device 10 is configured as a pin or bolt 27, which is axially movably mounted in a housing 28 preceding the delivery system 3. The housing 28 is arranged in the region of the delivery system 3 in such a way that the pin or the bolt 27 can exert a defined force directed perpendicular to the passing yarn 14 on the latter, as already described above. The change in the position of the pin or the bolt 27 by the axial movement thereof because of a change in the yarn tension is detected in the manner already described by means of the sensor system 11 and passed as a signal corresponding to the change to the control mechanism 13. The signal is used by the control mechanism 13 as a control variable for activating at least one of the delivery systems 2, 3 to dynamically compensate the change in the yarn tension of the yarn 14 between the two delivery systems 2, 3.

The invention claimed is:

1. Method for the thermal treatment of a running yarn (14) on a twisting machine with a large number of workstations, which in each case have a device (1) for the thermal treatment of the running yarn, which is preceded or followed, respectively, by a delivery system (2, 3), whereby the yarn (14) passes through the device (1) substantially without tension, and in that the yarn (14), after passing the downstream delivery system (3), is wound, characterised in that the passing yarn (14) is loaded with a defined force of an order of magnitude up to 1 cN by position-variable means (24, 25, 27), the position change of which caused by a change in the yarn tension because of disruptive influences during the thermal treatment of the yarn (14) being used as a control variable for controlling at least one of the delivery systems (2, 3).

2. Method according to claim 1, characterized in that the order of magnitude of the force applied to the yarn (14) is kept constant.

3. Method according to claim 1, characterized in that saturated steam or hot steam is used for the thermal treatment of the yarn (14).

4. Twisting machine for comprising a large number of workstations, which in each case have a device (1) for the thermal treatment of a running yarn (14), which is preceded or followed, respectively, by a delivery system (2, 3) the yarn (14) being held substantially without tension during the thermal treatment in the device (1) between the two delivery systems (2, 3), characterized in that a mechanism (10) for influencing the yarn tension is arranged between the two delivery systems (2, 3) and comprises means (24, 25, 27,), which are at least partially position-variable to load the yarn (14) with a defined force of an order of magnitude up to 1 cN, the mechanism (10) being connected to a control mechanism (13), which is set up to use the change in position of the means (24, 25, 26) of the control mechanism (13) as a control variable to control the speed at least of one of the delivery systems (2, 3).

5. Twisting machine according to claim 4, characterized in that each workstation has a sensor system (11), which determines the order of magnitude of the change in position of the mechanism (10) and passes it to the control mechanism (13).

6. Twisting machine according to claim 4, characterized in that the mechanism (10) is arranged in the region of one of the delivery systems (2, 3).

7. Twisting machine according to claim 4, characterized in that the mechanism (10) is arranged in a pivot pin (12) of a delivery system roller (8, 9) of one of the two delivery systems (2, 3) so as to be pivotable about the latter.

8. Twisting machine according to claim 7, in that the mechanism (10) has a lever (24), which can be pivoted about the pivot pin (12), with a deflection roller (25) rotatably arranged on the lever (24).

9. Twisting machine according to claim 4, characterized in that the mechanism (10) is configured as an axially movable bolt (27).

* * * * *